US005570481A

United States Patent [19]

Mathis et al.

[11] Patent Number: 5,570,481

[45] Date of Patent: Nov. 5, 1996

[54] SUCTION-ACTUATED CONTROL SYSTEM FOR WHIRLPOOL BATH/SPA INSTALLATIONS

[75] Inventors: Cleo D. Mathis, Hacienda Heights; Robert A. Miller, Fullerton; Scott A. Romano, Murrieta, all of Calif.; Peter M. Tracey, Edmunds, United Kingdom

[73] Assignee: Vico Products Manufacturing Co., Inc., South El Monte, Calif.

[21] Appl. No.: 338,148

[22] Filed: Nov. 9, 1994

[51] Int. Cl.[6] ..... A47K 3/00; E04H 4/12

[52] U.S. Cl. ..... 4/541.2; 4/504; 417/38; 200/83 J; 200/83 Z

[58] Field of Search ..... 4/504, 541.2; 417/38, 417/43; 200/83 J, 83 Z

[56] References Cited

U.S. PATENT DOCUMENTS

| | | | |
|---|---|---|---|
| 2,680,168 | 6/1954 | Murphy | 200/83 J |
| 2,767,277 | 10/1956 | Wirth | 200/83 Z |
| 4,107,492 | 8/1978 | Moon, Jr. et al. | 200/83 J X |
| 4,460,812 | 7/1984 | Asahi | 200/83 J |
| 4,620,835 | 11/1986 | Bell | 4/504 X |
| 4,762,969 | 8/1988 | Tracey | 200/83 J X |
| 4,783,580 | 11/1988 | Bassin | 200/83 J X |
| 4,867,645 | 9/1989 | Foster | 200/83 J X |

*Primary Examiner*—Robert M. Fetsuga
*Attorney, Agent, or Firm*—Wallace G. Walter

[57] ABSTRACT

A suction-actuated control system (10) for a whirlpool bath/spa installation includes a suction-side transducer (52) connected in the suction inlet path and a controller (54). The suction-side transducer (52) transmits an air pulse to the controller (54) when pressure in the suction path drops below a pre-determined value caused, for example, by a full or partial blockage of a suction cover (26) by a wash cloth or an article of clothing. The controller (54) includes an electric switch (62) in circuit with the recirculation pump (34) and a bi-state controller (66) that actuates the electric switch (62) between its ON state and its OFF state. An abnormally low pressure in the suction path to the recirculation pump (34) caused by a full or partial blockage of the suction cover (26) will cause the controller (54) to shut-off the recirculation pump (34). After the obstruction is removed and a short time delay, the user can actuate a user ON/OFF control (56) to restart the pump (34).

10 Claims, 5 Drawing Sheets

SUCTION-ACTUATED CONTROL SYSTEM FOR WHIRLPOOL BATH/SPA INSTALLATIONS

BACKGROUND OF THE INVENTION

The present invention relates to a suction-actuated control system for whirlpool bath/spa installations and, more particularly, to a control system for whirlpool/spa installations in which a decrease in suction-inlet pressure below a predetermined threshold will cause the system pump to shut-off.

Whirlpool bath and spa-type installations typically include a tub structure having a plurality of water jets for introducing a pressurized stream of water and air into the tub and a suction inlet from which water is withdrawn. The water withdrawn from the tub through the suction inlet is provided to a recirculation pump which pressurizes the water and distributes the pressurized water to the water jets for re-introduction into the tub. Typically, the suction inlet includes an apertured or slotted cover that prevents small objects from entering the suction path and being recirculated by the pump. Because of the localized water flow into the suction inlet, it is not unknown for objects (such as a wash cloth) in the tub to be drawn to and held against the apertured cover of the suction inlet. In this circumstance, the effective flow-area into the suction inlet can be partially blocked to substantially reduce flow through the pump.

SUMMARY OF THE INVENTION

In view of the above, it is an object of the present invention, among others, to provide a suction-actuated control system for whirlpool bath/spa installations that detects the effect of a fully or partially blocked suction inlet and provides a signal to shut-off the system pump.

It is another object of the present invention to provide a suction-actuated control system for whirlpool bath/spa installations that senses an undesired decrease in the water pressure in the suction inlet consequent to a fully or partially blocked suction inlet and provides a signal to shut-off the system pump.

It is still another object of the present invention to provide a suction-actuated control system for whirlpool bath/spa installations that is responsive to the pressure sensed in the suction inlet and which is both reliable in operation and inexpensive to implement.

The present invention advantageously provides a suction-actuated control system for whirlpool bath/spa installations of the type having a recirculation pump for removing water from the tub via a suction path and returning and reintroducing the water as one or more pressurized jets. A controller is responsive to successive commands from a user-operated control to turn the pump on and off as desired. A pressure-responsive transducer in fluid communication with the water suction path functions to detect a change in pressure in the suction line consequent to a full or partial blockage of the suction path and provide a signal to the controller that turns the pump off.

In a preferred form of the invention, the controller is defined as a pneumatically responsive device and an electrical switch that is in circuit with the recirculation pump. The pneumatically responsive device includes a diaphragm that defines a first chamber and a second chamber which are responsive to pneumatic signals to actuate the electrical switch. The first chamber is responsive to a first pneumatic signal from a user-operated control to actuate the electric switch to its on position and to a successive pneumatic signal from the user-operated control to actuate the electric switch to its off position. The second chamber is responsive to a pneumatic signal from a pressure-responsive sensor to actuate the electric switch to its off position.

The pressure-responsive sensor is connected to the suction line of the whirlpool bath or spa and provides a pneumatic turn-off signal to the second chamber of the pneumatically responsive device to actuate the electric switch to its off position. The pressure-responsive sensor is preferably of the diaphragm type having a mesa-shaped elastomer diaphragm with a non-linear response characteristic. The diaphragm retains its initial shape until a selected pressure differential is attained at which time the diaphragm moves rapidly and positively to a second position during which movement the pneumatic turn-off signal is provided to the second chamber of the pneumatically responsive device to actuate the electric switch to its off position.

The pneumatically responsive device includes a bistate actuator that controls the electric switch between its on and its off position. The bistate actuator is organized as two co-axially aligned and relatively movable axial-face cams that cooperate with an axially movable cam follower that is successively latched into one of two axial positions with each successive stroke of one of the axial-face cams. The two axial positions correspond to the on and off positions of the electric switch that controls the recirculation pump.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
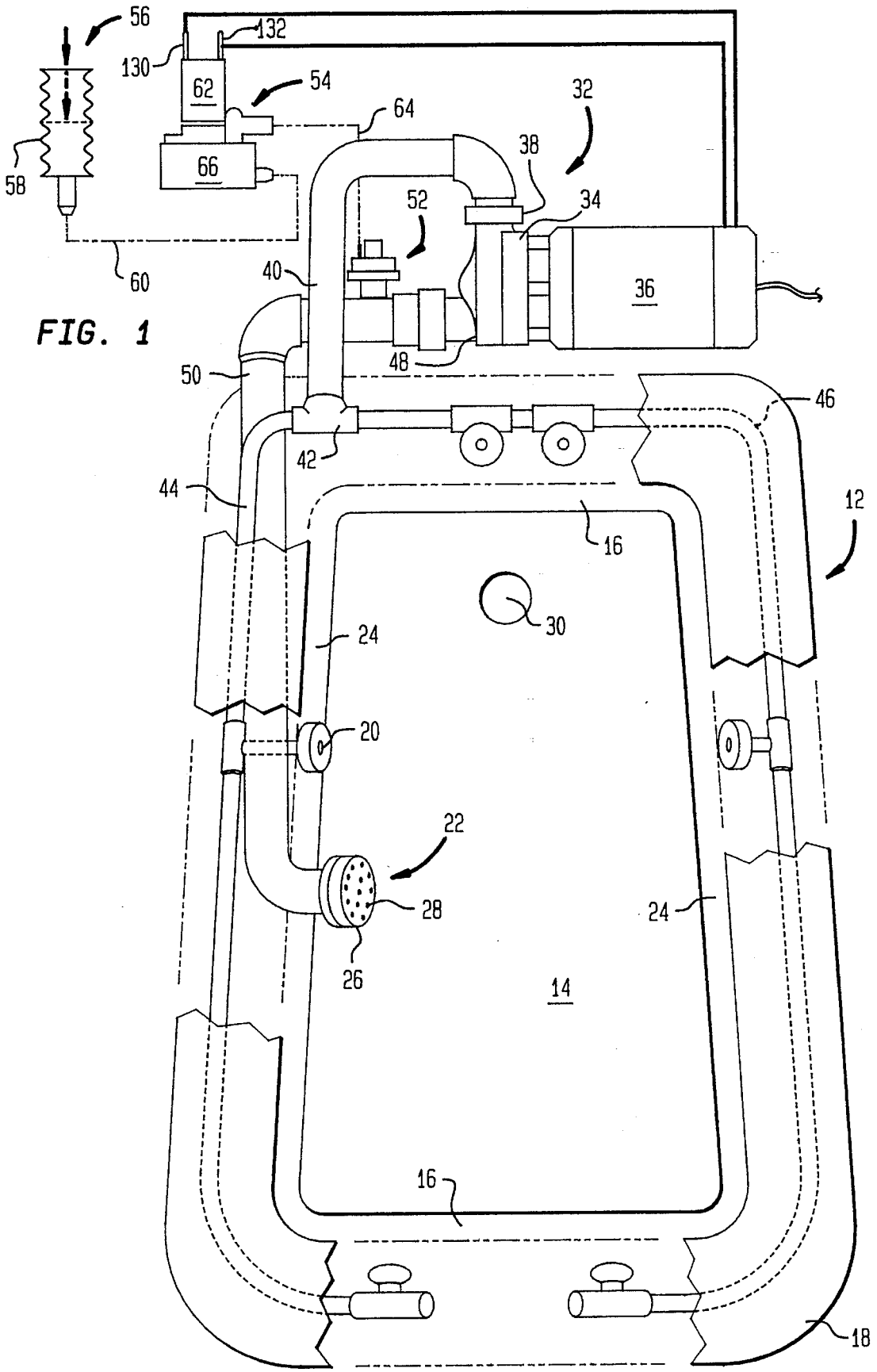
FIG. 1 is a top perspective view of a suction-actuated control system in association with a representative whirlpool bath/spa installation in accordance with the present invention.

A suction-actuated control system for whirlpool bath/spa installations in accordance with the present invention is shown in FIG. 1 and designated generally therein by the reference character 10. As shown, the system 10 is utilized in conjunction with a whirlpool bath/spa installation of which the particular tub configuration shown in FIG. 1 is representative. As shown, a tub 12 (shown in partial dotted-line illustration) includes a bottom wall 14, side walls 24, end walls 16, and a sill 18. A plurality of jets 20 are mounted on the various sidewalls and are designed to introduce pressurized water or pressurized water/air streams into the tub 12. A suction inlet 22 is located in one of the side walls 24 near the bottom wall 14. As shown, the suction inlet 22 includes a shield or suction cover 26 having a plurality of slots or holes 28. Lastly, a drain opening 30 is located in the bottom wall 14 for draining the tub 12.

The various jets 20 and the suction inlet 22 are connected to a pump assembly 32 that includes an impeller-type pump 34 connected to and driven by an electric motor 36. The pump outlet 38 is connected to distribution piping that includes a main outlet pipe 40 connected through a Y-fitting 42 to a left-side distribution pipe 44 and a right-side distribution pipe 46. The various jets 20 are connected to either the left-side distribution pipe 44 or the right-side distribution pipe 46 as shown. The pump inlet 48 is connected through an inlet pipe 50 to the suction inlet 22.

In normal operation, the drain opening 30 is closed and the tub 12 is filled with water to an appropriate depth. The pump 34 is turned on and water in the tub 12 is withdrawn from the tub 12 through the holes 28 of the suction cover 26 of the suction inlet 22 and into the inlet pipe 50 and into the pump inlet 48. The water is pressurized by the pump 34 and passed through the pump outlet 38 into the main outlet pipe 40 for distribution into the various jets 20 and reintroduction into the tub 12.

Since the volume of water that is ejected from the various jets 20 must pass through the holes 28 of the suction cover 26, the cross-sectional area of the holes 28 and the number of holes 28 are designed to accommodate the inflow volume. Occasionally, the suction cover 26 will become fully or partially blocked, for example, by a wash cloth or an article of clothing, causing a reduced water inflow into the pump 34.

In order to effect an automatic shut-off of the pump 34 in the event of a full or partial blockage of the water flow through the suction cover 26, the system 10 includes suction-side transducer 52 connected to the suction inlet path, preferably at or adjacent the pump inlet 48, an actuator/controller 54 connected to the suction-side transducer 52, and a user ON/OFF control 56 that is also connected to the controller 54. The user ON/OFF control 56 is defined by a compressable bladder or bellows 58 that is connected to the controller 54 by an ON/OFF tube 60 (typically a plastic or elastomer tube). Compression of the bellows 58 by the user causes an air pulse that actuates the controller 54, which, in turn, operates an electric switch 62. The suction-side transducer 52 is also connected to the controller 54 by a suction-signal tube 64 and functions, like the user ON/OFF control 56, to transmit an air pulse to the controller 54 when pressure in the suction path drops below a pre-determined value. The controller 54 is a bi-state controller 66 that actuates the electric switch 62 between its ON state and its OFF state. As explained more fully below in relationship to FIG. 2, the suction-side transducer 52 is designed to sense abnormally low pressure in the suction path caused by a full or partial blockage of the suction cover 26 and provide an air pulse signal to the controller 54 to shut-off the pump 34. After the obstruction is removed and a short time delay, the user can actuate the user ON/OFF control 56 to re-start the pump 34.

Figure 2:
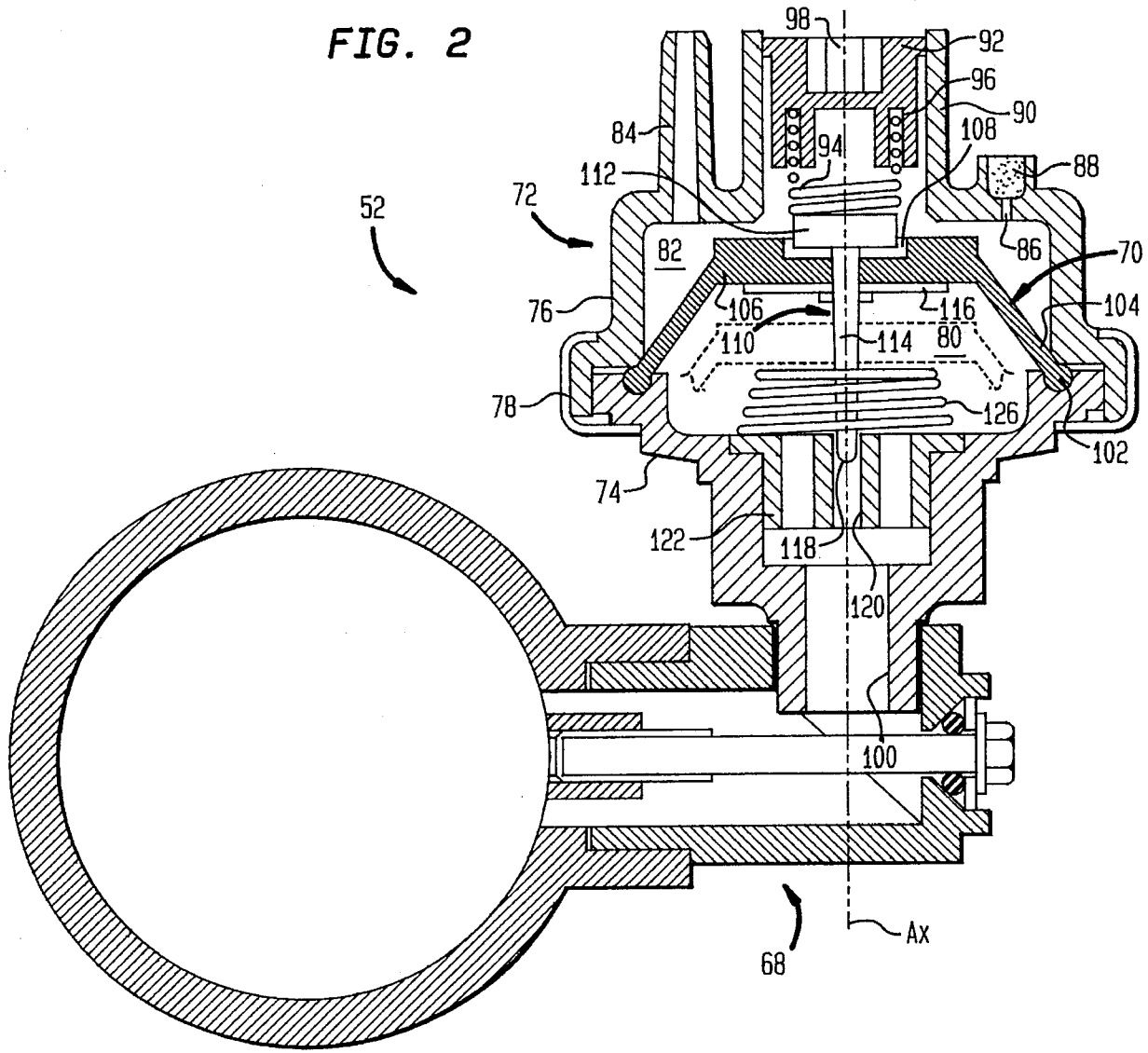
FIG. 2 is a side elevation view, in cross-section, illustrating a suction inlet pressure transducer.

As shown in FIG. 2, the suction-side transducer 52 is connected to the suction path at the pump inlet 48 through a connection fitting 68. As can be appreciated, the suction-side transducer 52 can be connected to the suction path at other points (i.e., at the inlet pipe 50). The suction-side transducer 52 includes a diaphragm 70 mounted in a housing 72 defined by a lower sub-housing 74 and a complementary upper sub-housing 76 secured together by a circumferential clamp ring 78. The diaphragm 70 and its housing 72 define a suction chamber 80 that is in fluid communication with the suction path (i.e., via the pump inlet 48) and a control chamber 82 on the opposite side of the diaphragm 70. The upper sub-housing 76 includes a connection port 84, a bleed hole 86, and a porous plastic filter 88 (stippled) inserted within an enlarged-diameter portion (unnumbered) of the bleed hole 86. The upper sub-housing 76 includes an internally threaded upper extension 90 that receives an externally threaded adjustment plug 92. A helical coil spring 94 is retained in an appropriately sized groove 96 and is intended to provide an adjustable preload force against the diaphragm 70 as explained below. The adjustment plug 92 includes a hexagonal recess 98 for receiving an adjusting tool. The lower sub-housing 74 is designed to be received within the connection fitting 68 and includes an externally threaded lower extension 100 that is in threaded engagement with an internally threaded opening (unnumbered) in the connection fitting 68. The upper sub-housing 76 and the lower sub-housing 74 are designed to mate with one another and are held in their assembled state by a clamp ring 78. The clamp ring 78, which is preferably formed from pressed sheet metal or the like, surrounds and circumferentially embraces the upper sub-housing 76 and the lower sub-housing 74 to secure the parts together.

The diaphragm 70 is formed symmetrically about a principal axis $A_x$ and is molded as a unitary shape-sustaining mesa-like structure from a suitable elastomer. The diaphragm 70 includes a peripheral diaphragm rim 102 retained in an appropriately sized annular groove (unnumbered) in the lower sub-housing 74, an inclined diaphragm sidewall 104 that defines a portion of a conic element, and a discoidal top 106 that joins with the diaphragm sidewall 104. A counterbore 108 is formed in the surface of the top 106 facing the upper sub-housing 76, and a through bore (unnumbered) is formed through the top of the top 106 at the center of the counterbore 108. A mandrill 110 having an enlarged-diameter head 112 and a shank 114 is mounted in the through bore formed in the center of the top 106 with the head 112 received within the counterbore 108. A plate 116 secures the mandrill 110 in position in the top 106. The lower end of the shank 114 has a rounded distal end 118 that is received within a guide bore 120 formed in a guide 122 retained in an appropriately sized counterbore (unnumbered) formed in the lower sub-housing 74. The adjustment spring 94 engages the top surface of the head 112. As can be appreciated, rotation of the adjustment plug 92 in one direction or the other about the principal axis $A_x$ will cause the adjustment plug 92 to advance toward or retract away from the diaphragm 70 and thereby change the force applied to the diaphragm 70 by the spring 94.

The diaphragm 70 is preferably fabricated from a silicone elastomer and, in its normal configuration, assumes the mesa-like shape shown in solid-line illustration in FIG. 2. The diaphragm 70 is designed with an intentional non-linear snap-action functional characteristic so that it will move rapidly and positively between its solid-line position in FIG. 2 and its dotted-line position. The top 106 can be substantially planar or slightly domed and is sufficiently thick relative to the diaphragm sidewall 104 to be substantially shape-sustaining throughout its range of motion. When the pressure in the suction chamber 80 is lower than that in the control chamber 82, a downwardly directed force in the direction of the lower sub-housing 74 will result tending to bias the diaphragm top 106 downward against the shape-sustaining forces provided by the diaphragm sidewall 104. As the pressure differential between the suction chamber 80 and the control chamber 82 increases, the magnitude of the downward force will increase until the shape-sustaining forces are overcome and the diaphragm sidewall 104 abruptly begins to fold downward. As the diaphragm sidewall 104 folds downward and forms a convolution, those internal shape-sustaining forces in the diaphragm 70 diminish further to allow the discoidal top 106 to move rapidly and positively toward the lower sub-housing 74, as shown in dotted-line illustration in FIG. 2. The adjustment plug 92 can be rotated in one direction or the other to apply a preload force to the diaphragm 70 and thus control the point at which the diaphragm 70 will snap to its actuated position. A return spring 126 is mounted in the lower sub-housing 74 and undoes a measure of compression when the diaphragm 70 is in its fully actuated position. When the pressure differential between the suction chamber 80 and the control chamber 82 is relieved, the potential energy stored in the return spring 126 and the shape-restoring forces of the diaphragm 70 will return the diaphragm 70 to its normal mesa-like configuration (as shown in solid-line illustration in FIG. 2). The bleed hole 86 and its filter 88 serve to allow pressure equalization with the ambient atmosphere as explained below. However, the airflow rate through the bleed hole 86 and its filter 88 is sufficiently small as to not substantially affect the intended cooperation between the suction-side transducer 52 and the bi-state controller 66.

As presented in FIG. 1, the electric switch 62 is a momentary-action push switch having a depressable switch button (not shown in FIG. 1) and two terminals, switch terminal 130 and switch terminal 132. The electric switch 62 is in series circuit (either directly or through a relay or relay equivalent) with the motor 36 and the power source. As described below, the bi-state controller 66 is designed to latch the switch button of the electric switch 62 in either its ON or OFF position, depending upon the control signals provided by the user ON/OFF control 56 or the suction-side transducer 52.

Figure 3:
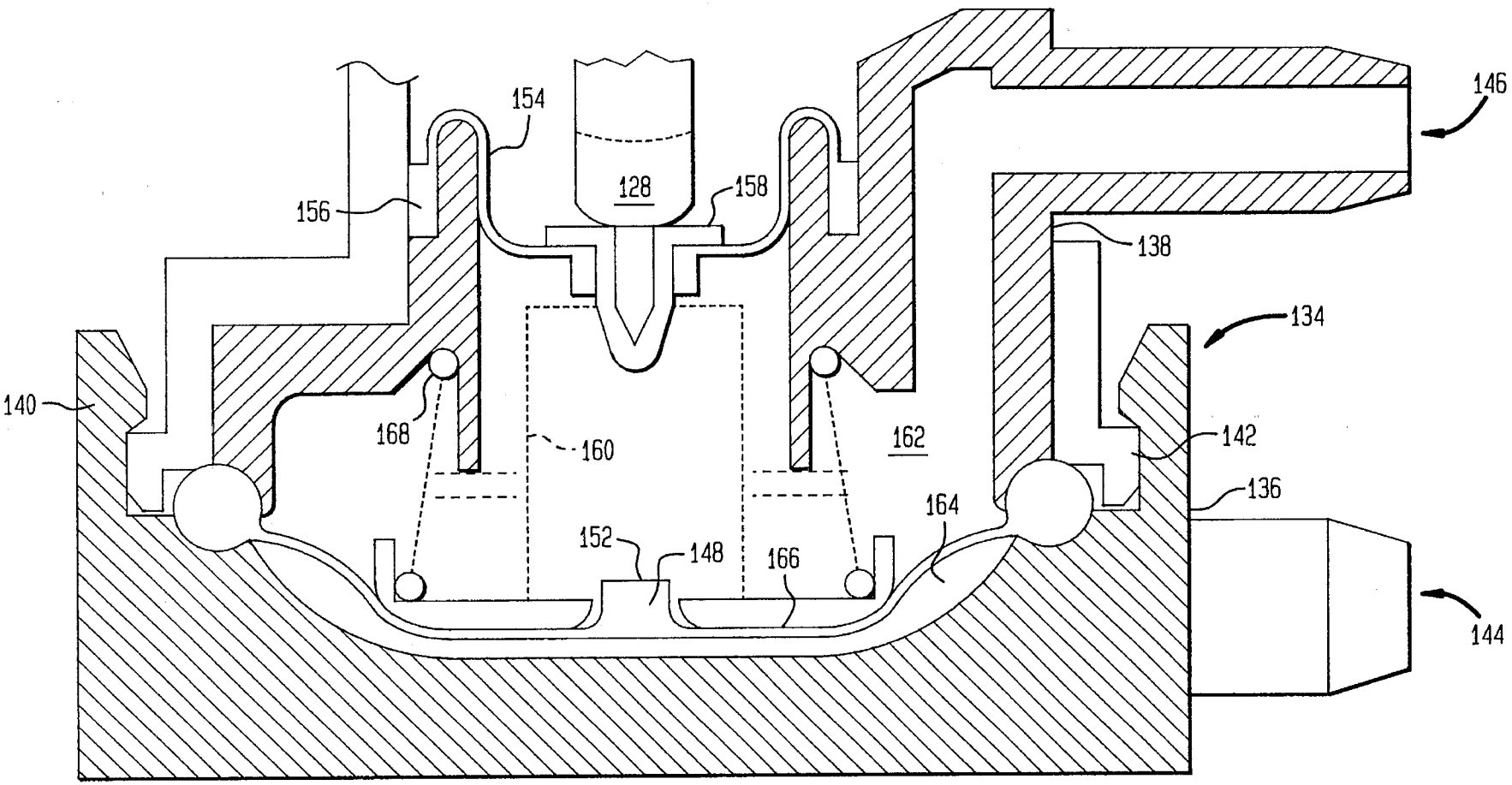
FIG. 3 is a side elevation view, in cross-section, illustrating a bi-state controller.
Figure 4:
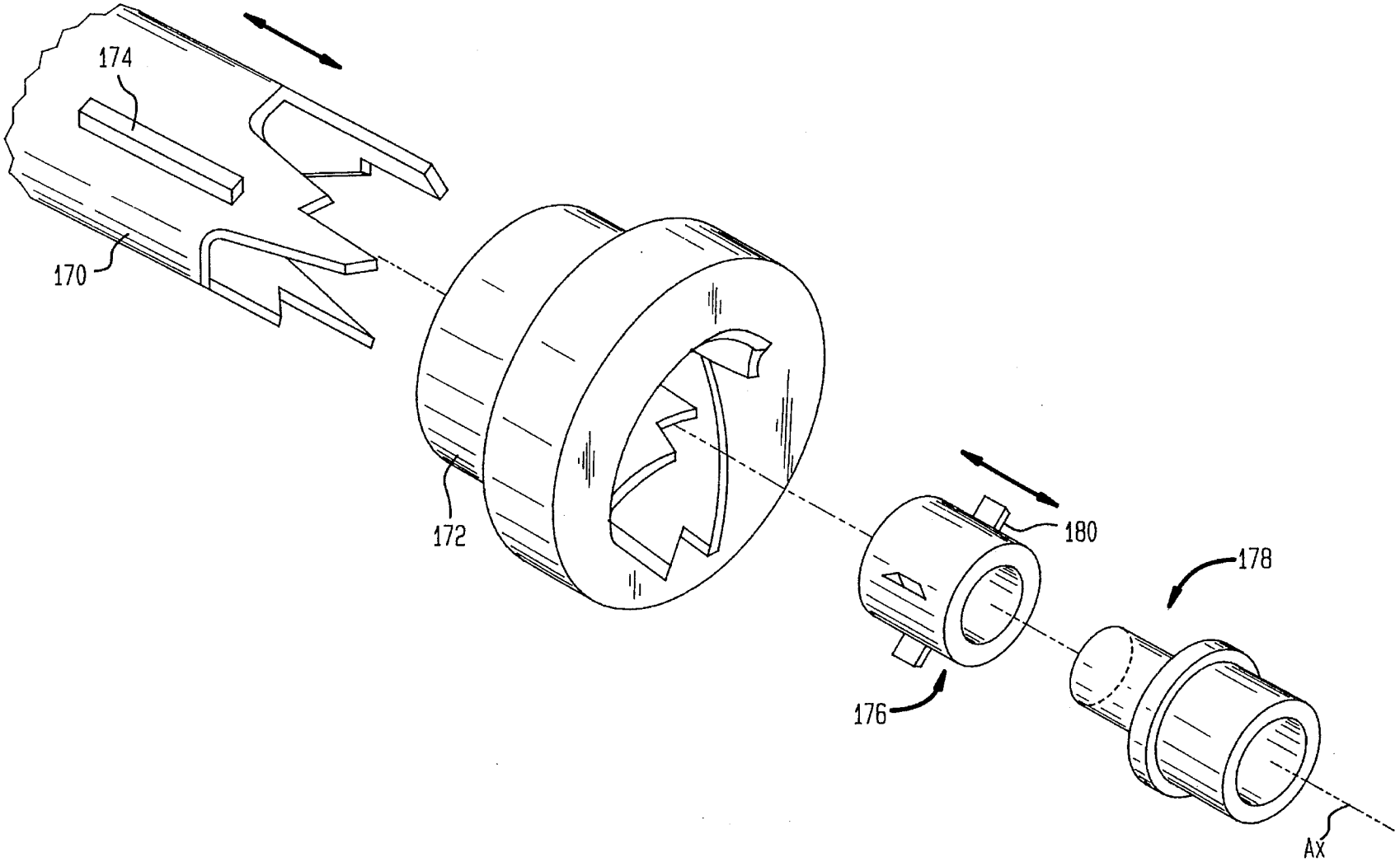
FIG. 4 is an exploded perspective view of the major components of an alternate-action axial cam mechanism.

As shown in FIG. 3, the bi-state controller 66 includes a housing 134 assembled from a lower housing 136 and an upper housing 138. The lower housing 136 includes an upstanding lower housing rim 140 that receives and captures a radially outward flange 142 to provide a snap-together assembly. The lower housing 136 includes an ON/OFF signal port 144 that connects to the ON/OFF tube 60 and to the bellows 58, and the upper housing 138 includes a suction-signal port 146 that connects to the suction-side transducer 52 through the suction-signal tube 64. A lower diaphragm 148 includes an enlarged peripheral lower diaphragm rim 150 (having a circular cross-section) that is captured between appropriately contoured portions of the lower housing 136 and the upper housing 138. The lower diaphragm 148 includes a central stub 152 on the side opposite from the lower housing 136. In a similar manner, an upper diaphragm 154 includes an enlarged peripheral upper diaphragm rim 156 that is retained in an appropriately sized annular groove (unnumbered) and includes a centrally disposed interposer 158 that extends through the upper diaphragm 154. The interposer 158 is positioned between the switch button 128 and an alternate-action mechanism 160 (dotted-line illustration), described more fully below in relation to FIGS. 4–9. The switch button 128 is mounted to engage the surface of the interposer 158 and is displaced (dotted-line illustration) by movement of the alternate-action mechanism 160 and the connected interposer 158, as described below. The assembled lower housing 136 and upper housing 138 and the lower diaphragm 148 and upper diaphragm 154 define a suction-side chamber 162 therebetween that is in fluid communication with the suction-signal port 146 and the suction-side transducer 52 through the suction-signal tube 64. In addition, the lower housing 136 and the lower diaphragm 148 define an ON/OFF chamber 164 on the side of the lower diaphragm 148 opposite from the suction-side chamber 162. The ON/OFF chamber 164 is in fluid communication with the ON/OFF signal port 144 and the bellows 58 through the ON/OFF tube 60.

The alternate-action mechanism 160 is located within the suction-side chamber 162 and extends between the lower diaphragm 148 and the interposer 158 that is connected to the upper diaphragm 154. The alternate-action mechanism 160 is designed to alternately move the switch button 128 between its undepressed and its depressed positions. As explained below, the alternate-action mechanism 160 is organized as two co-axially aligned and relatively movable axial-face cams that cooperate with an axially movable cam follower that is successively latched into one of two axial positions with each successive axial stroke of one of the axial-face cams. The two axial positions correspond to the ON and OFF positions of the electric switch 62.

As shown in FIG. 3, the alternate-action mechanism 160 includes a contact pad 166 that is biased by a preload spring 168 to resiliently urge the lower diaphragm 148 against a conforming surface of the lower housing 136. The contact pad 166 is movable between the solid-line and dotted-line positions illustrated. As shown in more detail in the partial exploded perspective of FIG. 4, a lift cam 170 is connected to the contact pad 166. The lift cam 170 is formed as a cylindrical body about the longitudinal axis $A_x$ and includes axial-face cam surfaces described more fully below. A position-holding cam 172 is mounted to and secured within an appropriately sized bore (unnumbered) in the upper housing 138 and also includes axial-face cam surfaces that cooperate with those of the lift cam 170. The lift cam 170 is slidably received within the position-holding cam 172 and is designed to reciprocate between an initial and an advanced position within the position-holding cam 172 in response to movement of the lower diaphragm 148. One or more axially aligned spines 174 are provided on the outside diameter surface of the lift cam 170 and cooperate with spine-receiving grooves (not shown) formed in the interior of the position-holding cam 172 to maintain the parts in rotational alignment. A cam follower 176 is rotatably mounted on a cam follower shaft 178 and includes cam follow arms 180 that extend radially outward and engage or are engaged by the axial-face cam surfaces of the lift cam 170 and the position-holding cam 172. The cam follower shaft 178 is in contact with the interposer 158 which, in turn, is in contact with the switch button 128 (FIG. 3). As the lift cam 170 is advanced rightwardly along the longitudinal axis $A_x$ in response to movement of the lower diaphragm 148, the axial-face surfaces of the lift cam 170 and the position-holding cam 172 cooperate to successively advance or retract the cam follower 176 to one of two axial positions to thus control operation of the switch button 128.

Figure 5:
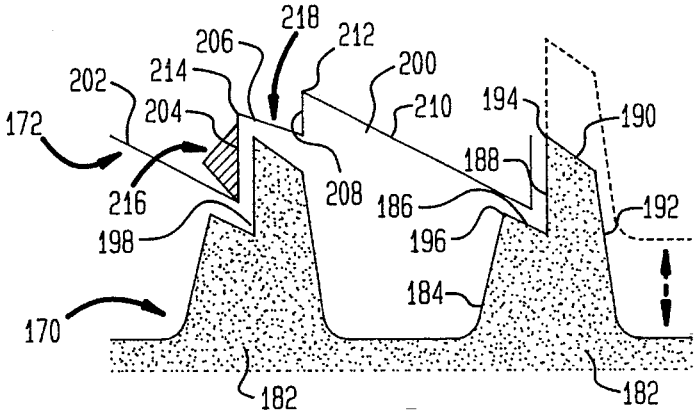
FIG. 5 is a flat development of the cam profile of two cooperating axial-face cams in a first operative relationship.
Figure 6:
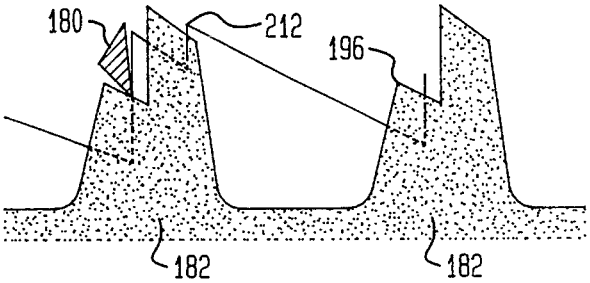
FIG. 6 is a flat development of the cam profile of two cooperating axial-face cams in a second operative relationship.
Figure 7:
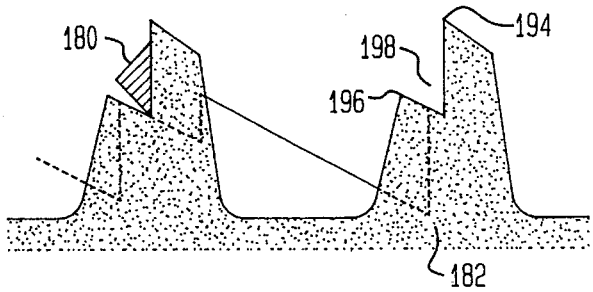
FIG. 7 is a flat development of the cam profile of two cooperating axial-face cams in a third operative relationship.

As shown in schematic form in the flat-development view of FIG. 5, the axially movable lift cam 170 (stippled) includes spaced-apart axial-face cam formations 182 that each include an inclined surface 184, a declining surface 186, a substantially vertical inclined surface 188, a declining surface 190, and a declining surface 192. A maxima 194 is defined between the inclined surface 188 and the declining surface 190, a sub-maxima 196 is defined between the inclined surface 184 and the declining surface 186, and, lastly, a notch 198 is defined between the declining surface 186 and the inclined surface 188. As represented in dotted-line and by the bi-directional arrow, the lift cam 170 is reciprocated between an initial position (solid-line illustration) and an advanced position (dotted-line illustration) by operation of the lower diaphragm 148.

The relatively stationary position-holding cam 172 includes cam formations 200 that each include a declining surface 202, an inclined surface 204, a declining surface 206, an inclined surface 208, and a declining surface 210. The intersection of the inclined surface 208 and the declining surface 210 define a maxima 212, and the intersection of the inclined surface 204 and the declining surface 206 define a sub-maxima 214. A notch 216 is formed at the intersection of the declining surface 202 and the inclined surface 204, and a notch 218 is formed at the intersection of the declining surface 206 and the inclined surface 208. The lift cam 170 and the position-holding cam 172 are maintained in the relationship shown by the spines 174 as mentioned above. A representative cam follow arm 180 (in cross-section) is shown positioned in and retained in the notch 216.

Figure 8:
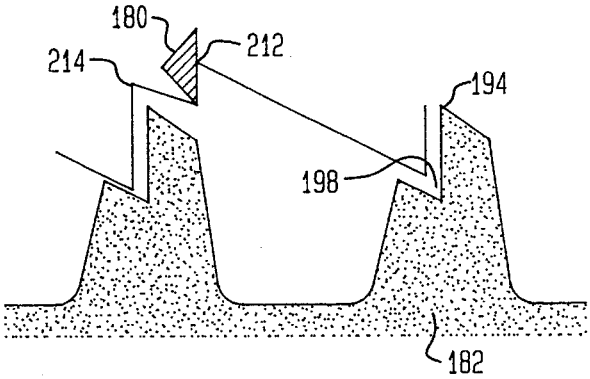
FIG. 8 is a flat development of the cam profile of two cooperating axial-face cams in a fourth operative relationship.
Figure 9:
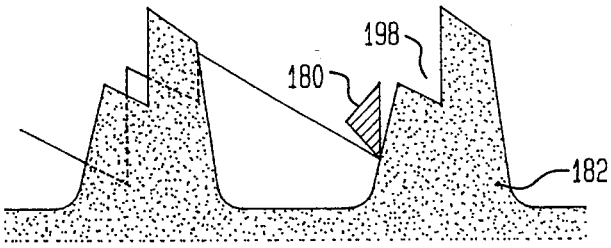
FIG. 9 is a flat development of the cam profile of two cooperating axial-face cams in a fifth operative relationship.

The alternate action operation of the alternate-action mechanism 160 can be appreciated from the respective operating positions represented sequentially in FIG. 5 to FIG. 9. As shown in FIG. 5, the cam follow arm 180 is positioned and retained in the notch 216, this position corresponding to retracted position of the two alternate positions. As the lift cam 170 is advanced axially upward in FIG. 6, the cam follow arm 180 is lifted from the notch 216 by the declining surface 186 and carried above the sub-maxima 214. The cam follower arms 180 slides down the declining surface 186 (to the right in FIG. 6) and comes to rest in the notch 198 (FIG. 7) as the lift cam 170 returns to its initial position. As can be appreciated, the cam follower 176 is now retained at its advanced axial position (FIG. 8). With the next successive axial stroke of the lift cam 170, the declining surface 190 contacts the cam follow arm 180 and lifts the cam follow arm 180 sufficiently above the maxima 212 to cause the cam follow arm 180 to slide down the declining surface 206 and come to rest in the notch 216 at the initial axial position of the cam follower 176 (FIG. 9). During successive axial strokes of the lift cam 170, the cam follower 176 is rotated about the longitudinal axis $A_x$ as it is successively positioned between its initial and its advanced axial positions.

In normal operation, the user closes the drain opening 30, fills the tub 12 with water, and operates the user ON/OFF control 56 by compressing and releasing the bellows 58 to provide an air-pressure pulse through the ON/OFF tube 60 to the bi-state controller 66. This air-pressure pulse is transmitted into the ON/OFF chamber 164 of the bi-state controller 66 through the ON/OFF tube 60 and the ON/OFF signal port 144. The lower diaphragm 148 is deflected by the pressure increase in the ON/OFF chamber 164 to axially advance the contact pad 166 and its lift cam 170. The contact pad 166 returns to its initial position as the bellows 58 is released. The reciprocation of the lift cam 170 increments the cam follower 176 to its advanced position to thereby actuate the electric switch 62 to is ON position through movement of the interposer 158 and the switch button 128. The pump 34 is turned-on to begin water recirculation. In order to turn-off the pump 34, the user again operates the user ON/OFF control 56 to compress and release the bellows 58 to provide a second air-pressure pulse through the ON/OFF tube 60 to the bi-state controller 66. This second air-pressure pulse causes the lower diaphragm 148 to again axially advance and retract the contact pad 166 and its lift cam 170 to increment the cam follower 176 to the next successive initial position to actuate switch button 128 of the electric switch 62 to is OFF position through movement of the interposer 158.

In the event that the suction cover 26 is blocked by a wash cloth or the like, the pressure in the suction path to the pump inlet 48 will decrease. The decrease in pressure is communicated to the suction chamber 80 through the lower extension 100. At some point the diaphragm 70 will snap to its dotted-line position in FIG. 2 to cause a pressure drop that is communicated through the connection port 84 and the suction-signal tube 64 to the suction-signal port 146 and to the suction-side chamber 162. The reduction in pressure in the suction-side chamber 162 will cause the lower diaphragm 148 to axially advance the contact pad 166 and its lift cam 170 to its advanced position. Air flow through the filter 88 and the bleed hole 86 will cause the pressure in the suction-side chamber 162 to increase toward ambient with the lower diaphragm 148, the connected contact pad 166, and the lift cam 170 returning toward their initial positions to increment the cam follower 176 to the next successive initial position to actuate the electric switch 62 to its OFF position. The air-flow rate through the filter 88 controls the time duration of the shut-off function. A smaller air-flow rate through the filter 88 and the bleed hole 86 will increase the time duration to shut-off while a larger air-flow rate through the filter 88 and the bleed hole 86 will decrease the time duration to shut-off. In general, a two-to-four second delay is desired to prevent shut-off by a momentary blockage of the suction cover 26.

The present invention advantageously provides a suction-actuated control system for whirlpool bath/spa installations that detects the effect of a fully or partially blocked suction inlet and provides a signal to shut-off the system pump and which is both reliable in operation and inexpensive to implement.

As will be apparent to those skilled in the art, various changes and modifications may be made to the illustrated suction-actuated control system for whirlpool bath/spa installations of the present invention without departing from the spirit and scope of the invention as determined in the appended claims and their legal equivalent.

What is claimed is:

1. A suction-actuated control system for use with whirlpool bath/spa installations of the type having a motor driving a recirculation pump for removing water from a tub through a suction path and for returning and reintroducing the water as pressurized jets and an actuatable electric switch in circuit with the motor, the system comprising:

a fluidically controllable actuator coupled to the electric switch for actuating the switch between a first position to complete an electric circuit with the motor and a second position to interrupt the electric circuit and having means to mechanically latch the switch in each of said first and second positions, said actuator successively actuating the switch between said first and second positions in response to successive first fluidic signals, said actuator responsive to a second fluidic signal different from said first fluidic signal to cause the switch to assume its second position;

means, operable by a system user, to apply successive first fluidic signals to said actuator to complete and interrupt the electric circuit;

a transducer coupled to the suction path for detecting a pre-determined pressure in the suction path and for providing the second fluidic signal to said actuator to cause the switch to assume its second position.

2. The suction-actuated control system for use with whirlpool bath/spa installations of claim 1, wherein said user operable means comprises a user-depressable bellows to provide successive first fluidic signals to said actuator.

3. The suction-actuated control system for use with whirlpool bath/spa installations of claim 1, wherein said transducer comprises a diaphragm surface mounted in a housing and defining a first chamber in fluid communication with said actuator and a second chamber in fluid communication with the suction path.

4. The suction-actuated control system for use with whirlpool bath/spa installations of claim 1, wherein said transducer comprises an elastomer surface mounted in a housing and defining a first chamber in fluid communication with said actuator and a second chamber in fluid communication with the suction path.

5. The suction-actuated control system for use with whirlpool bath/spa installations of claim 1, wherein said transducer comprises an elastomer mesa-shape diaphragm mounted in a housing and defining a first chamber in fluid communication with said actuator transducer and a second chamber in fluid communication with the suction path.

6. A suction-actuated control system and whirlpool bath/spa combination having a motor driving a recirculation pump for removing water from a tub through a suction path and for returning and reintroducing the water as pressurized jets and an actuatable electric switch in circuit with the motor, the system comprising:

a pneumatically controllable actuator coupled to the electric switch for actuating the switch between a first position to complete an electric circuit with the motor and a second position to interrupt the electric circuit with the motor and having means to mechanically latch the switch in each of said first and second positions, said actuator successively actuating the switch between said first and second positions in response to successive first pneumatic signals, said actuator responsive to a second pneumatic signal different from said first pneumatic signal to cause the switch to assume its second position to interrupt the electric circuit with the motor;

means, operable by a system user, to apply successive first pneumatic signals to said actuator to successively complete and interrupt the electric circuit;

a transducer coupled to the suction path for detecting a pre-determined pressure in the suction path and for providing the second fluidic signal to said actuator to cause the switch to assume its second position.

7. The combination of claim 5, wherein said user-responsive control comprises a user-depressable bellows.

8. The combination of claim 5, wherein said transducer comprises a diaphragm surface mounted in a housing and defining a first chamber in fluid communication with said transducer and a second chamber in fluid communication with the suction path.

9. The combination of claim 5, wherein said transducer comprises an elastomer surface mounted in a housing and defining a first chamber in fluid communication with said transducer and a second chamber in fluid communication with the suction path.

10. The combination of claim 5, wherein said transducer comprises an elastomer mesa-shape diaphragm mounted in a housing and defining a first chamber in fluid communication with said transducer and a second chamber in fluid communication with the suction path.

* * * * *